US008699305B2

(12) United States Patent
Nakamura et al.

(10) Patent No.: US 8,699,305 B2
(45) Date of Patent: Apr. 15, 2014

(54) SOLAR CELL ELECTRONIC DEVICE

(75) Inventors: Hisao Nakamura, Chiba (JP); Hiroshi Kawamata, Chiba (JP)

(73) Assignee: Seiko Instruments Inc. (JP)

( * ) Notice: Subject to any disclaimer, the term of this patent is extended or adjusted under 35 U.S.C. 154(b) by 97 days.

(21) Appl. No.: 13/495,139

(22) Filed: Jun. 13, 2012

(65) Prior Publication Data

US 2012/0327750 A1 Dec. 27, 2012

(30) Foreign Application Priority Data

Jun. 15, 2011 (JP) ..... 2011-133530

(51) Int. Cl.
*G04G 19/00* (2006.01)
*G04C 10/02* (2006.01)
*G04G 17/02* (2006.01)

(52) U.S. Cl.
CPC ..... *G04C 10/02* (2013.01); *G04G 17/02* (2013.01); *G04G 19/00* (2013.01)
USPC ..... 368/205; 368/291; 368/294

(58) Field of Classification Search
USPC ..... 368/88, 205, 291, 294–296; 136/244, 136/251
See application file for complete search history.

(56) References Cited

U.S. PATENT DOCUMENTS 4,234,947 A * 11/1980 Matsumoto ..... 368/287
6,521,822 B2 * 2/2003 Ito et al. ..... 136/244
6,791,905 B1 * 9/2004 Sekiguchi ..... 368/80

FOREIGN PATENT DOCUMENTS

JP 11337670 10/1999

* cited by examiner

*Primary Examiner* — Vit W Miska
(74) *Attorney, Agent, or Firm* — Adams & Wilks

(57) ABSTRACT

A solar cell electronic device includes a cover glass fitted into a case opening of an exterior case via a glass packing, and a solar panel disposed on the back face of the cover glass with a predetermined distance from the cover glass. The case opening has a base portion on the inner periphery thereof for mounting an outer peripheral portion of the cover glass and for positioning the solar panel in a plane direction. The glass packing includes a packing main body interposed between the case opening and the cover glass, and a flange portion that extends from an end on the base portion side of the packing main body and that is interposed between the cover glass and the base portion. The base portion has a base opening through which at least a part of the flange portion is exposed.

12 Claims, 6 Drawing Sheets

SOLAR CELL ELECTRONIC DEVICE

BACKGROUND OF THE INVENTION

1. Field of the Invention

This invention relates to solar cell electronic devices.

2. Description of the Related Art

An example of a solar cell electronic device is a digital wrist watch equipped with a solar panel. In this type of digital wrist watch, a liquid crystal display section is mounted on the front side of an exterior case, and a cover glass is mounted over the liquid crystal display section. The solar panel is mounted on the back face of the cover glass.

The solar panel is disposed at a predetermined distance from the cover glass to suppress transmission of the external impact on the wrist watch via the cover glass. Further, the solar panel is often disposed over a large area in the planar central portion of the cover glass to provide a large surface area for receiving light.

Further, in many cases, the cover glass is configured so as to be removable from the exterior case by itself. In this case, a packing is interposed between the exterior case and the cover glass to provide sealing.

In this way, for example, only the cover glass needs to be replaced when it is damaged, and the economical burden on a user can be reduced. Further, the packing interposed between the exterior case and the cover glass can prevent entry of dust and other foreign objects into the exterior case. For example, dust and other foreign objects entered between the exterior case and the solar panel during the assembly of a digital wrist watch can be removed by removing the cover glass, and the watch may then be reassembled to improve the product yield (see, for example, JP-A-11-337670).

In the foregoing related art, the cover glass is removed from the exterior case by pressing the cover glass outwardly from the inner side of the exterior case. Here, because the solar panel is disposed over a larger area on the back face of the cover glass, it is difficult to directly press the cover glass, and instead the solar panel is directly pressed to push out the cover glass with the solar panel. Further, because of the packing interposed between the exterior case and the cover glass, a greater pressure is needed to remove the cover glass.

This is problematic because it may damage the solar panel in the process of removing the cover glass.

Further, because the solar panel is disposed on the back face of the cover glass, the solar panel blocks the space surrounded by the cover glass and the solar panel, and the space surrounded by the solar panel and the caseback attached to the back side of the exterior case.

For a waterproof test of a wrist watch, a method is available in which the finished exterior case with a caseback is heated to increase the temperature inside the exterior case and vaporize the trace amount of the entered moisture, and thereafter the cover glass surface is cooled to check for any condensation on the inner surface of the cover glass and to determine whether water has entered the exterior case. However, a waterproof test performed by using this method is problematic, because the solar panel blocking the space inside the exterior case restricts the movement of the air inside the exterior case, and makes it difficult to accurately perform the waterproof test.

SUMMARY OF THE INVENTION

It is an aspect of the present application to provide a solar cell electronic device in which the solar panel can be prevented from being damaged when removing the cover glass from the exterior case, and with which the accuracy of a waterproof test can be improved.

According to the application, there is provided a solar cell electronic device that includes:

an exterior case having a case opening;

a packing attached to the case opening;

a cover glass mounted on the exterior case so as to be fitted into the case opening via the packing, and to close the case opening; and a solar panel disposed on a back face of the cover glass over a large area in a planar central portion of the cover glass with a predetermined distance from the cover glass, the case opening having a base portion formed on the inner periphery thereof for mounting an outer peripheral portion of the cover glass, and for positioning the solar panel in a plane direction, the packing including:

a main body portion interposed between the case opening and the cover glass; and a flange portion that extends from an end on the base portion side of the main body portion, and that is interposed between the cover glass and the base portion, the base portion having a base opening through which at least a part of the flange portion of the packing is exposed.

With this configuration, the cover glass can be pressed outward at the outer peripheral portion from the inner side of the exterior case through the base opening even in a solar cell electronic device in which the solar panel is disposed over a large area in the planar central portion of the cover glass. Accordingly, there is no need to directly press the solar panel for the removal of the cover glass, and damage to the solar panel can be prevented.

In the solar cell electronic device according to the application, the packing may have a cut-away portion formed in a part of the packing by cutting the flange portion.

With this configuration, the spaces on the both sides of the solar panel can be in communication with each other via the cut-away portion. In this way, there will be no restriction in the movement of the air inside the exterior case, and a waterproof test can be performed at high accuracy.

In the solar cell electronic device according to the application, the base opening may be formed at a position corresponding to the cut-away portion.

With this configuration, the spaces on the both sides of the solar panel can be more reliably in communication with each other, and the accuracy of a waterproof test can be further improved.

Further, because the cover glass can be exposed through the base opening, the outer peripheral portion of the cover glass can be directly pressed. In this way, the applied pressure can efficiently transmit to the cover glass, and the cover glass can be removed even more easily.

In the solar cell electronic device according to the application, a raised portion may be formed at a position corresponding to the base opening of the packing so as to face the base opening.

With this configuration, a load can be applied to the packing more easily when pressing the packing through the base opening, and the applied pressure can easily transmit to the cover glass via the packing. This makes it possible to remove the cover glass more easily.

In the solar cell electronic device according to the application, the base opening may be disposed in at least two locations apart from each other with respect to the center in a planar central portion of the cover glass.

With this configuration, a load can be applied to the outer peripheral portion of the cover glass in good balance. In this way, damage to the cover glass can be prevented even more reliably in the process of removing the cover glass, and the cover glass can be removed even more easily.

According to the application, the cover glass can be pressed outwardly at the outer peripheral portion from the inner side of the exterior case through the base opening even in a solar cell electronic device in which the solar panel is disposed over a larger area in the planar central portion of the cover glass. Accordingly, there is no need to directly press the solar panel for the removal of the cover glass, and damage to the solar panel can be prevented.

Further, the spaces on the both sides of the solar panel can be in communication with each other via the cut-away portion. In this way, there will be no restriction in the movement of the air inside the exterior case, and a waterproof test can be performed at high accuracy.

DESCRIPTION OF THE PREFERRED EMBODIMENTS

First Embodiment

Solar Cell Wrist Watch

First Embodiment of the invention is described below with reference to FIG. 1 to FIG. 6.

Figure 1:
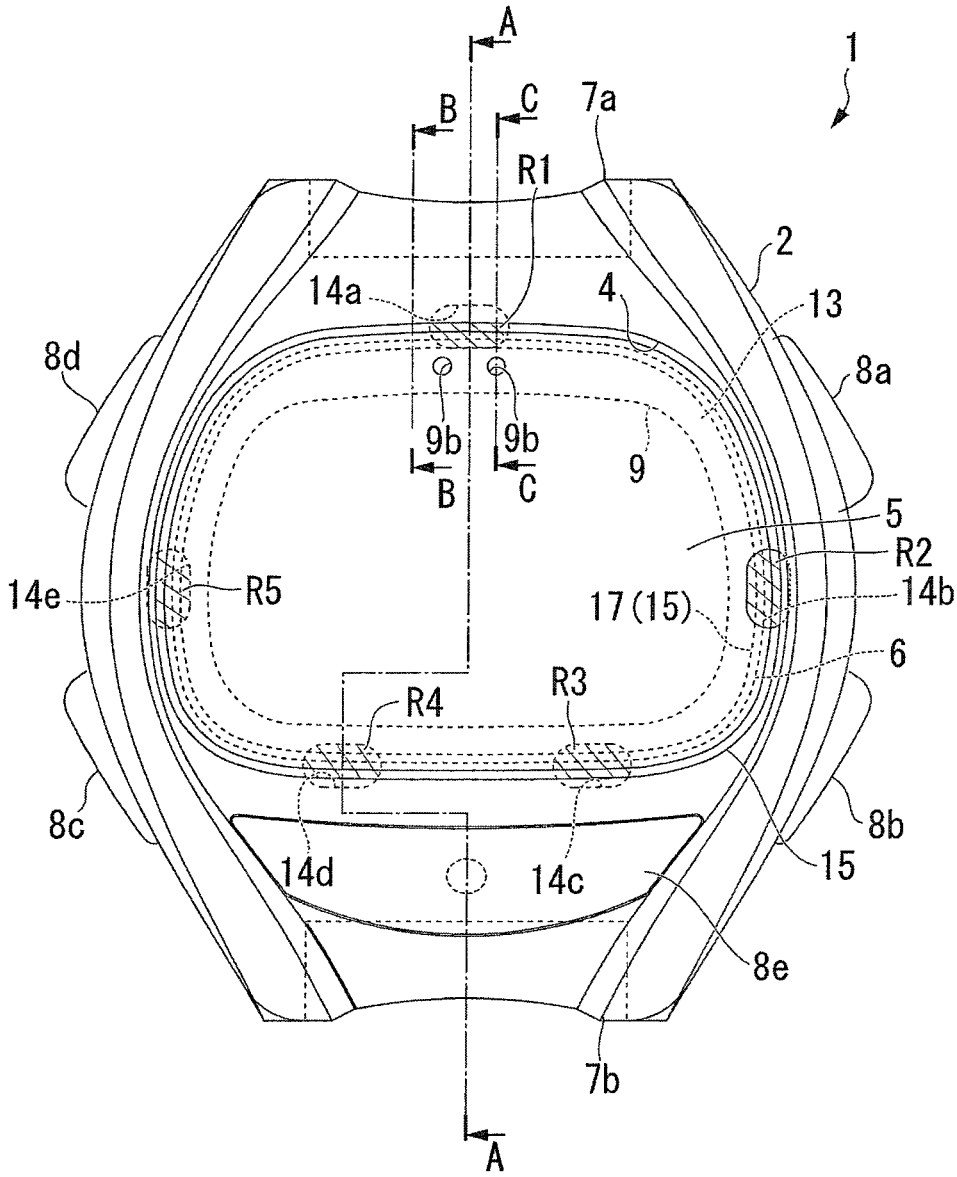
FIG. 1 is a front view of a solar cell wrist watch of First Embodiment of the invention.
Figure 2:
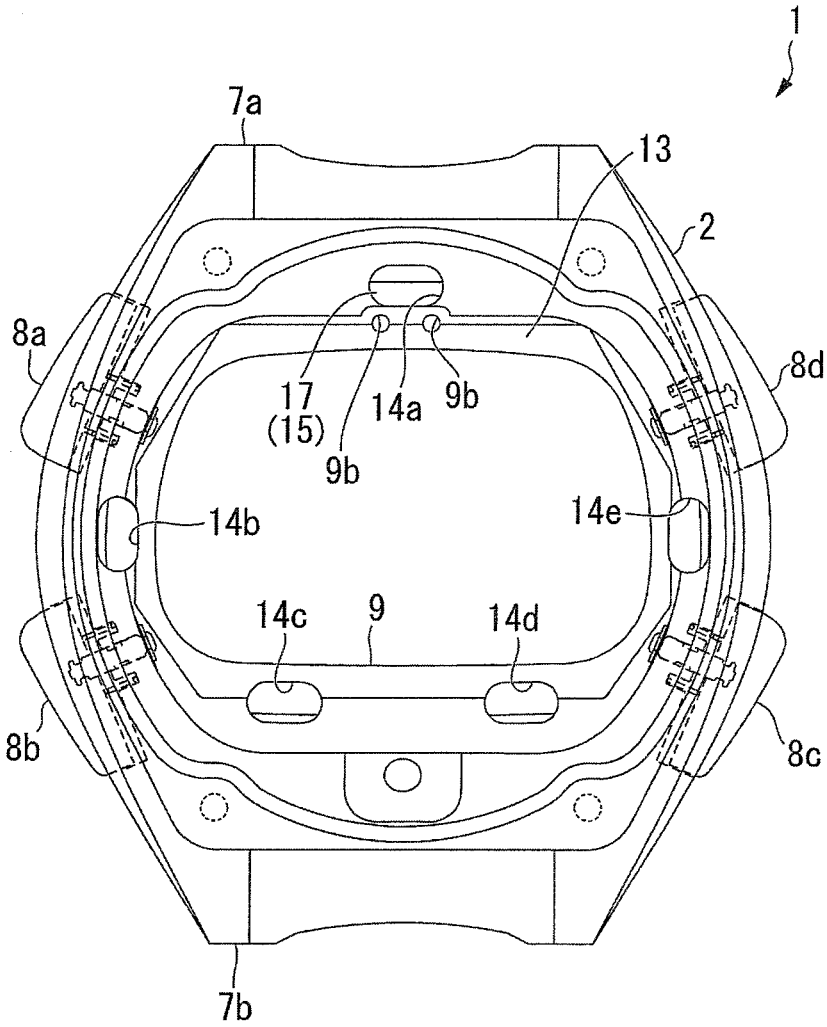
FIG. 2 is a plan view of an exterior case of First Embodiment of the invention as viewed from the back side with the caseback removed.
Figure 3:
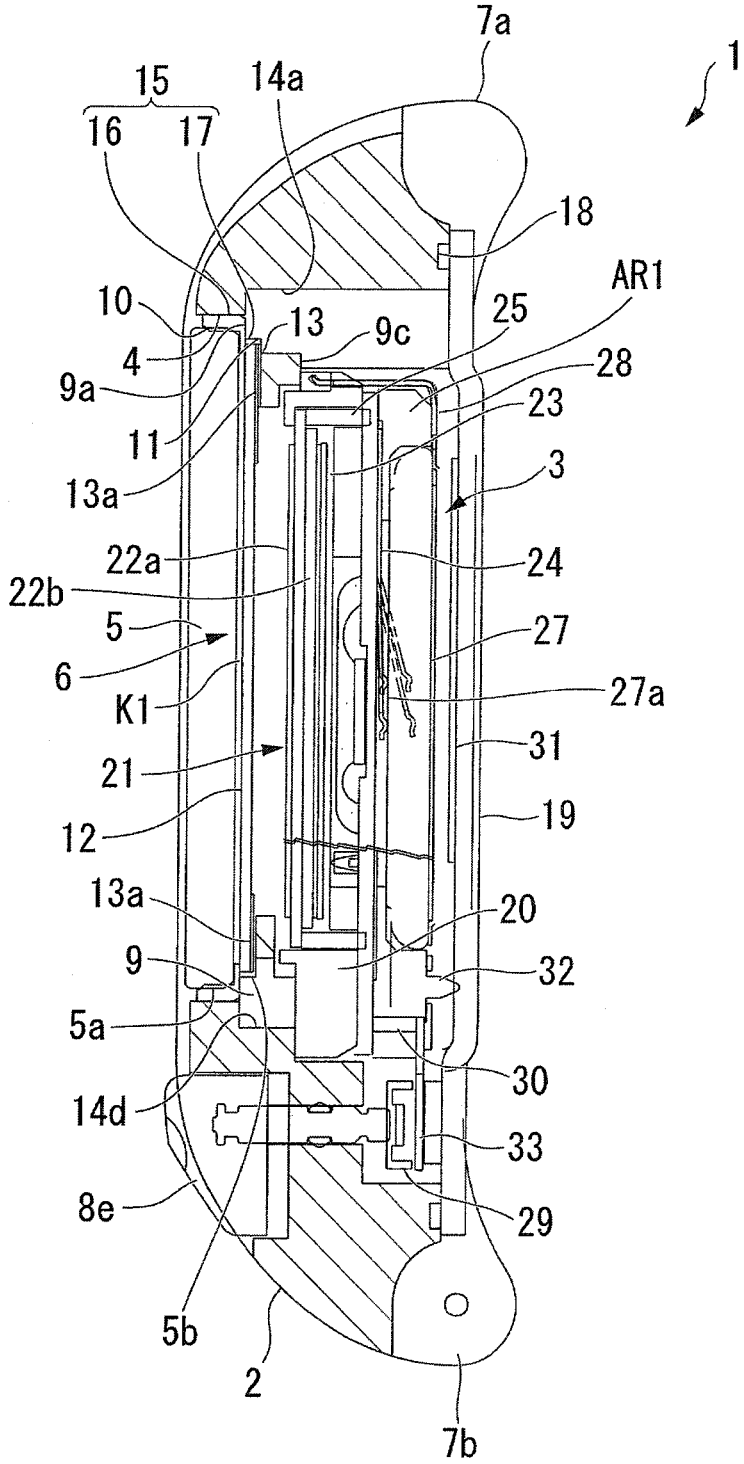
FIG. 3 is a cross sectional view taken along the line A-A of FIG. 1.
Figure 4:
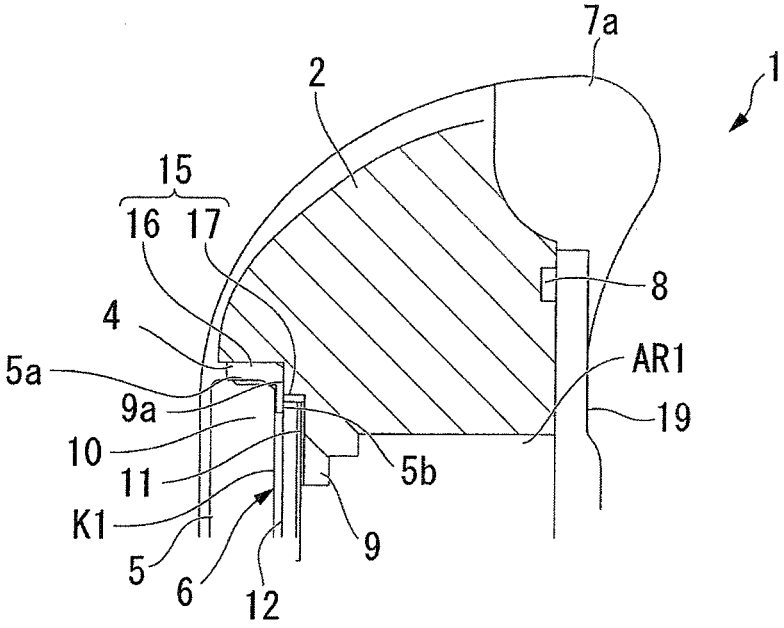
FIG. 4 is a cross sectional view taken along the line B-B of FIG. 1.

FIG. 1 is a front view of a solar cell wrist watch 1. FIG. 2 is a plan view of an exterior case 2 as viewed from the back side with a caseback 19 removed. FIG. 3 is a cross sectional view taken at the line A-A of FIG. 1. FIG. 4 is a cross sectional view taken at the line B-B of FIG. 1.

In the following, the side in contact with the wrist of a user wearing the solar cell wrist watch 1 will be referred to as the back side, and the side opposite the back side and facing outward will be referred to as the front side.

As illustrated in FIG. 1 to FIG. 4, the solar cell wrist watch 1 as a solar cell electronic device includes the exterior case 2, a watch movement 3 housed inside the exterior case 2, a cover glass 5 formed over a large area in the central portion of the exterior case 2, and closing the front-surface side (left-hand side in FIGS. 3 and 4) of a case opening 4 formed through the exterior case 2 in the thickness direction, and a solar panel 6 (solar cell) mounted on the back side of the cover glass 5 (right-hand side in FIGS. 3 and 4).

The exterior case 2 on the side surface has band attachment portions 7*a* and 7*b* respectively provided on the 6 o'clock and 12 o'clock side to attach watch bands (not illustrated). Further, the exterior case 2 has four switches 8*a* to 8*d* on the side surface, and a switch 8*e* on the 6 o'clock side on the front (left-hand side in FIGS. 3 and 4). The switches 8*a* to 8*e* are provided to switch the display content of a liquid crystal panel 21 (described later).

The case opening 4 of the exterior case 2 has a base portion 9 formed over the whole periphery in portions of the inner peripheral surface closer to the front side, and that projects inwardly along the radial direction. The case opening 4, with a top surface 9*a* of the base portion 9, forms a cover glass housing portion 10. The cover glass 5 is fitted to the cover glass housing portion 10 via a glass packing 15.

Glass Packing

Figure 5:
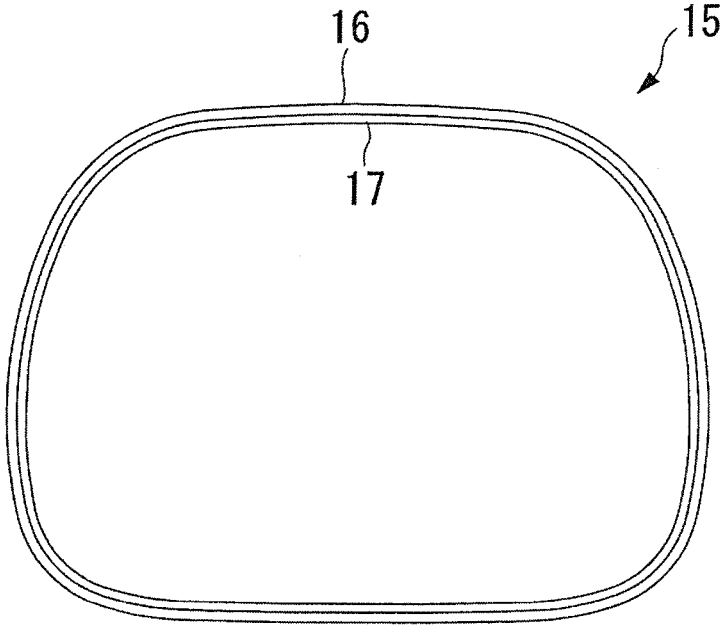
FIG. 5 is a plan view of a glass packing of First Embodiment of the invention.

FIG. 5 is a plan view of the glass packing 15.

As illustrated in FIG. 3 to FIG. 5, the glass packing 15 is formed into a substantially ring-shape corresponding to the case opening 4 in a planar view, and has a substantially L-shaped cross section. Specifically, the glass packing 15 is configured from a packing main body 16 disposed along the inner peripheral surface of the case opening 4, and a flange portion 17 that bends and extends inwardly along the radial direction from an end on the back side of the packing main body 16. The packing main body 16 is interposed between a side surface 5*a* of the cover glass 5 and the inner peripheral surface of the case opening 4, and undergoes slight compressional deformation between the side surface 5*a* and the case opening 4.

The cover glass 5 is mounted on the base portion 9 at an outer peripheral portion 5*b*. Accordingly, the flange portion 17 of the glass packing 15 is interposed between the back face of the outer peripheral portion 5*b* and the top surface 9*a* of the base portion 9, and undergoes compressional deformation between the cover glass 5 and the base portion 9. This ensures the sealing between the exterior case 2 and the cover glass 5.

Referring back to FIGS. 1 to 4, a depression 11 is formed on the front side along the whole periphery on the inner peripheral portion of the base portion 9. The solar panel 6 is mounted in the depression 11 at the outer peripheral portion.

The solar panel 6 has a glass substrate 12. The glass substrate 12 is formed so that its projected area becomes slightly smaller than the projected area of the cover glass 5, and is disposed over a large area in a planar central portion of the cover glass 5. In other words, the glass substrate 12 is formed in a shape corresponding to the outer shape of the depression 11. Thus, mounting the glass substrate 12 in the depression 11 brings the glass substrate 12 in position in both the thickness and plane directions.

The outer peripheral portion of the glass substrate 12 is designated as a cell forming region 13. A plurality of solar cells 13*a* is formed over one surface of the cell forming region (right-hand side in FIG. 3) along the circumferential direction. Each solar cell 13*a* has a semiconductor junction such as a PN junction and a PIN junction inside, and is realized by using common solar cell materials, including silicon semiconductor materials such as monocrystalline silicon, polycrystalline silicon, and amorphous silicon; compound semiconductor materials such as GaAs and CuInSe; and dye sensitized materials.

In FIGS. 1 and 2, only the cell forming region 13 of the glass substrate 12 is shown, and the solar cells 13*a* are omitted.

The depression 11 for mounting the glass substrate 12 is set to a depth that substantially coincides with the thickness of the glass substrate 12. Thus, the glass substrate 12 mounted in the depression 11 is substantially flush with the top surface 9*a* of the base portion 9. On the other hand, a predetermined gap K1 is formed between the cover glass 5 and the solar panel 6 by the presence of the flange portion 17 of the glass packing 15 between the top surface 9*a* of the base portion 9 and the cover glass 5. The gap K1 is closed by the surrounding members, specifically by the cover glass 5, the solar panel 6, the base portion 9, and the glass packing 15.

Five base openings 14*a* to 14*e* are formed through the base portion 9 in the thickness direction, and disposed apart from one another with respect to the center in the central portion of the case opening 4.

More specifically, the base openings 14*a* to 14*e* are substantially ellipsoidal in shape along the circumferential direction of the base portion 9, and are formed at the 12 o'clock, o'clock, 5 o'clock, 7 o'clock, and 9 o'clock side, respectively. The flange portion 17 of the glass packing 15 is exposed through the base openings 14*a* to 14*e* at the back of the base portion 9.

Specifically, the inner peripheral surface of the case opening 4 (the region from the outer periphery of the packing main body 16 forming the glass packing 15 to the inner periphery of the flange portion 17 forming the glass packing 15) is exposed at the 12 o'clock base opening 14*a* through region R1 (hatched portion R1 in FIG. 1) covering the area from the center to one end of the base opening 14*a* along the shorter axis.

As for the base openings 14*b* to 14*e* respectively formed at the 3, 5, 7, and 9 o'clock side, the region from the outer periphery of the packing main body 16 of the glass packing 15 to the inner periphery of the flange portion 17 is exposed through substantially the entire areas of regions R2, R3, R4, and R5 (hatched portions R2, R3, R4, and R5 in FIG. 1) along the shorter axis.

Note that the shape of the base openings 14*a* to 14*e* is not limited to the shape illustrated in FIGS. 1 and 2, as long as a part of the flange portion 17 of the glass packing 15 can be exposed at the base openings 14*a* to 14*e*.

Further, a packing groove 18 is formed on the back side of the exterior case 2 so as to surround the case opening 4. A caseback packing (not illustrated) is attached to the packing groove 18, and the caseback 19 is provided so as to close the back side of the case opening 4. The watch movement 3 is disposed in a space AR1 between the caseback 19 and the base portion 9 inside the exterior case 2.

The watch movement 3 has a panel frame 20 of a substantially ring shape. The back side of the base portion 9 of the exterior case 2 serves as a watch movement support face 9*b*, and the panel frame 20 is mounted on the watch movement support face 9*b*.

A liquid crystal panel 21 is held to the front side of the panel frame 20. Specifically, the liquid crystal panel 21 is mounted on the exterior case 2 via the panel frame 20.

The liquid crystal panel 21 includes a liquid crystal sealed between a pair of glass substrates 22*a* and 22*b*, and is provided to display time and other information. An EL (electroluminescence) panel 23 is provided on the back side of the liquid crystal panel 21 to illuminate the liquid crystal panel 21 from the back side.

The solar panel 6 is disposed on the front side of the liquid crystal panel 21 so as to cover the entire front surface of the liquid crystal panel 21. The solar panel 6 thus blocks the front surface of the liquid crystal panel 21 from a user. However, the solar panel 6 is configured to include the glass substrate 12 and the solar cells 13*a* formed over one surface of the glass substrate 12, and the solar cells 13*a* are formed in the cell forming region 13 provided on the outer peripheral portion of the glass substrate 12. This allows a user to see the displayed content on the liquid crystal panel 21 through the solar panel 6.

A circuit board 24 is provided on the back side of the EL panel 23 provided on the panel frame 20. The circuit board has a predetermined wiring pattern on the surface. Electronic components are mounted in predetermined positions of the wiring pattern. Examples of the electronic components include IC chips and capacitors provided for oscillations for displaying time and other information on the liquid crystal panel 21.

A conductive rubber 25 is provided on the front side of the circuit board 24 at a position corresponding to the outer peripheral portion of the liquid crystal panel 21 and across the circuit board 24 and the liquid crystal panel 21. The circuit board 24 and the liquid crystal panel 21 are electrically connected to each other via the conductive rubber 25.

The circuit board 24 is also electrically connected to the solar panel 6.

Figure 6:
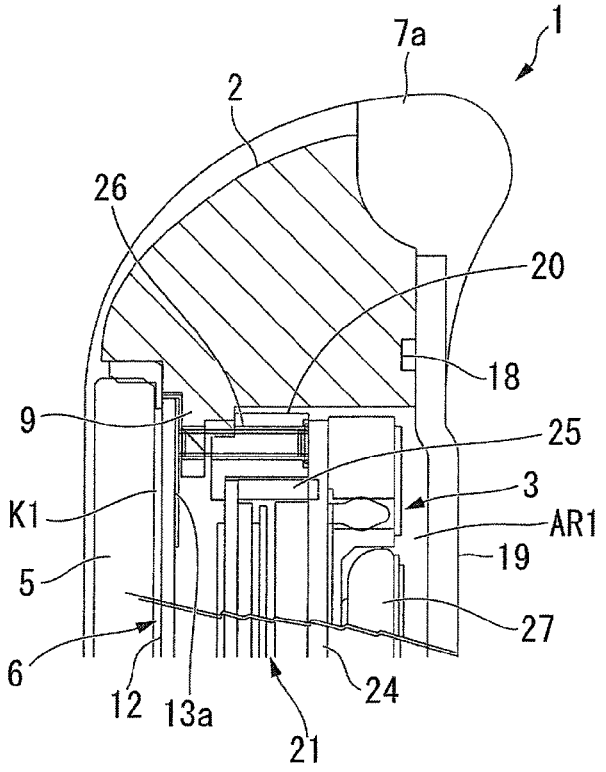
FIG. 6 is a cross sectional view taken along the line C-C of FIG. 1.

FIG. 6 is a cross sectional view along the line C-C of FIG. 1.

As illustrated in FIGS. 1 and 6, two connection terminals 26 are provided on the 12 o'clock side of the circuit board 24 across the circuit board 24 and the solar panel 6. The connection terminals 26 are conductive members realized by, for example, a coil spring. Through holes 9*b* for inserting the connection terminals 26 are formed through the exterior case 2 in portions corresponding to the connection terminals 26. The connection terminals 26 are connected at one end to the circuit board 24, and to the solar cells 13*a* of the solar panel 6 at the other end through the through holes 9*b*. In this way, the circuit board 24 and the solar cells 13*a* are electrically connected to each other. Note that the connection terminals 26 are not limited to coil springs, and, for example, a conductive rubber may be used.

As illustrated in FIG. 3, a button-type secondary battery 27 as a driving power supply for the electronic components is mounted on the back side of the circuit board 24. A battery terminal 27*a* is provided on the back side of the circuit board 24, and the secondary battery 27 and the circuit board 24 are electrically connected to each other via the battery terminal 27*a*. The secondary battery 27 is held to a battery frame 28 fixed to the circuit board 24.

The four switches 8*a* to 8*d* provided on the side surface of the exterior case 2 are electrically connected to the outer periphery of the circuit board 24. The liquid crystal panel 21 switches its display based on the operation of the switches 8*a* to 8*d*.

A sub-substrate 33 is provided on the 6 o'clock side of the circuit board 24. The sub-substrate 33 is provided to electrically connect the circuit board 24 to the switch 8*e* provided on the 6 o'clock side of the exterior case 2. The switch 8*e* contacts with and separates from the sub-substrate 33 via a rubber switch 29. A connector terminal 30 provided across the battery frame 28 and the circuit board 24 is provided between the sub-substrate 33 and the circuit board 24. The connector terminal 30 is realized by, for example, a conductive rubber or a coil spring, and electrically connects the sub-substrate 33 and the circuit board 24 to each other. In this way, the liquid crystal panel 21 switches its display based on the operation of the switch 8*e*.

A piezoelectric buzzer 31 is provided on the inner surface of the caseback 19. The piezoelectric buzzer 31 is a laminate of a piezoelectric ceramic thin plate (piezoelectric element; polarized along the thickness direction) and a thin metal (or resin) oscillating plate.

The watch movement 3 is provided with a caseback holding member 32 that protrudes toward the caseback 19. The caseback holding member 32 is provided to suppress movement of the caseback 19.

Cover Glass Removing Method

The following describes a method of removing the cover glass 5 from the exterior case 2.

First, the caseback 19 is removed from the exterior case 2, and then the watch movement 3 is removed. In this state, the solar panel 6 is exposed on the back side of the exterior case 2 over a large area at the center, and the base openings 14*a* to 14*e* are also exposed on the back side of the exterior case 2. The flange portion 17 of the glass packing 15 is exposed through the base openings 14*a* to 14*e* (regions R1 to R5, see FIG. 1).

The flange portion 17 of the glass packing 15 can thus be directly pressed through the base openings 14*a* to 14*e* using a jig or the like (not illustrated) to push the cover glass 5 outward.

The base openings 14*a* to 14*e* are disposed apart from one another with respect to the center in the central portion of the case opening 4, specifically with respect to the center in the planar central portion of the cover glass 5. More specifically, the base openings 14*a* to 14*e* are substantially ellipsoidal in shape along the circumferential direction of the base portion 9, and are formed on the 12 o'clock, 3 o'clock, 5 o'clock, 7 o'clock, and 9 o'clock side, respectively. This makes it possible to push and remove the cover glass 5 outwardly under the balanced load applied over the entire outer peripheral portion of the cover glass 5.

The cover glass 5 is fitted into the cover glass housing portion 10 of the exterior case 2 under the pressure causing slight compressional deformation in the glass packing 15. Thus, for example, a pressure of about 10 kgf to 20 kgf is needed to push the cover glass 5 outward. However, because the pressure is applied to the glass packing 15, the cover glass 5 can be removed without transmitting the pressure to the solar panel 6.

According to the First Embodiment described above, the cover glass 5 can be removed without damaging the solar panel 6.

Further, because the base openings 14*a* to 14*e* are disposed apart from one another with respect to the center in the central portion of the cover glass 5, the cover glass 5 can be pushed and removed outwardly under the balanced load applied over the entire outer peripheral portion of the cover glass 5. In this way, the cover glass 5 will not be damaged by the applied local load, and can be easily removed.

Second Embodiment

Second Embodiment of the invention is described below with reference to FIGS. 7 and 8. Note that, in this and the subsequent embodiment, the same features already described in First Embodiment will be described using the same reference numerals.

Figure 7:
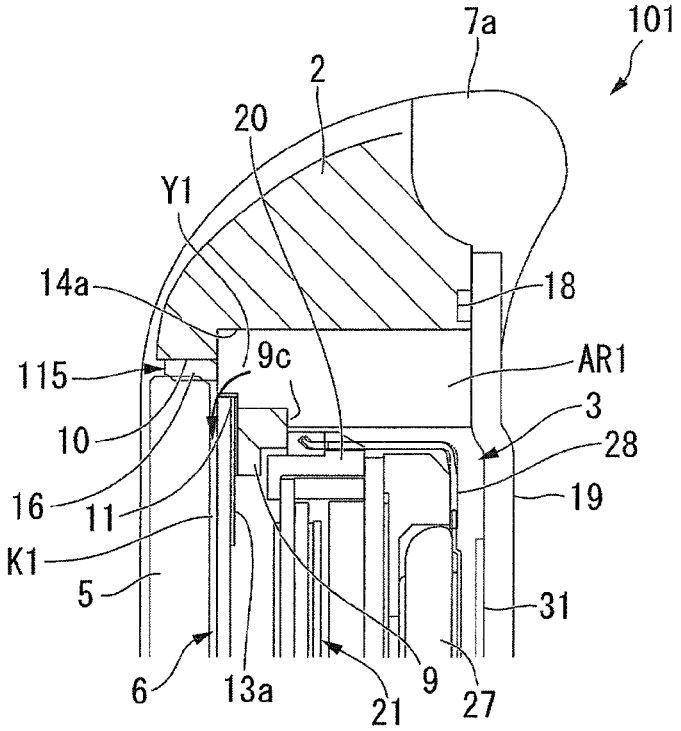
FIG. 7 is a partial longitudinal sectional view of a solar cell wrist watch of Second Embodiment of the invention.

FIG. 7 is a partial longitudinal sectional view of a solar cell wrist watch 101, corresponding in part to FIG. 3. FIG. 8 is a plan view of a glass packing 115.

In the second and subsequent embodiment below, the solar cell wrist watch 101 (201) has the same basic configuration described in First Embodiment. Specifically, the solar cell wrist watch 101 includes the exterior case 2, the watch movement 3 housed inside the exterior case 2, the cover glass 5 formed over a large area in the central portion of the exterior case 2, and closes the front-surface side (left-hand side in FIG. 8) of the case opening 4 formed through the exterior case 2 in the thickness direction, and the solar panel 6 (solar cell) mounted on the back side of the cover glass 5 (right-hand side in FIG. 8). The case opening 4 of the exterior case 2 has the base portion 9 formed over the whole periphery in portions of the inner peripheral surface closer to the front side, and projecting inwardly along the radial direction. The cover glass 5 is fitted to the cover glass housing portion 10 of the base portion 9 via the glass packing 115. The solar panel 6 is mounted in the depression 11 of the base portion 9.

Second Embodiment differs from First Embodiment in that the glass packing 115 of Second Embodiment has a different shape from the shape of the glass packing 15 of First Embodiment.

Figure 8:
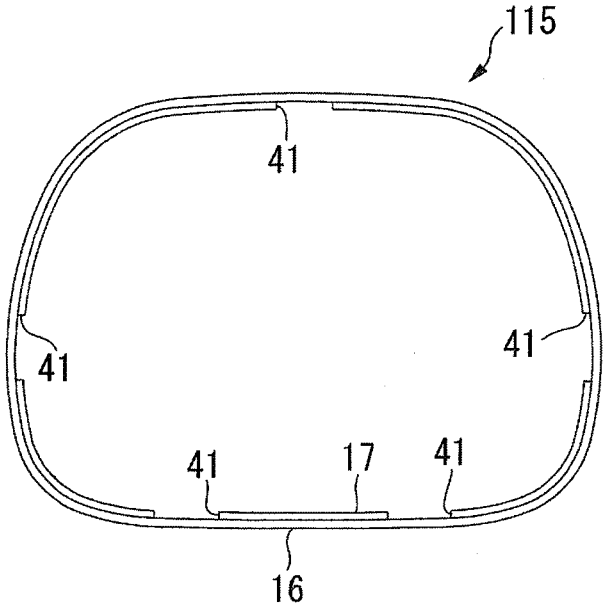
FIG. 8 is a plan view of a glass packing of Second Embodiment of the invention.

Specifically, as illustrated in FIGS. 7 and 8, the glass packing 115 of Second Embodiment has cut-away portions 41 in the flange portion 17 at positions corresponding to the base openings 14*a* to 14*e* of the base portion 9. That is, the cut-away portions 41 are formed on the 12 o'clock, 3 o'clock, 5 o'clock, 7 o'clock, and 9 o'clock side of the flange portion 17.

The glass packing 115 configured as above has a substantially I-shaped cross section at the cut-away portions 41. Thus, the outer peripheral portion of the cover glass 5 is directly exposed through the base openings 14*a* to 14*e*.

Further, as illustrated in FIG. 7 in detail, the cut-away portions 41 make the base openings 14*a* to 14*e* in communication with the gap K1 formed between the cover glass 5 and the solar panel 6. Specifically, through the base openings 14*a* to 14*e*, the gap K1 is in communication with the space AR1 formed between the caseback 19 and the base portion 9.

With this configuration, there will be movement of air between the gap K1 and the space AR1 through the base openings 14*a* to 14*e*. That is, for example, entry of water into the space AR1 inside the exterior case 2 causes the moisture-containing air to be channeled toward the gap K1 through the base openings 14*a* to 14*e* (arrow Y1, see FIG. 7).

When the temperature inside the exterior case 2 is increased in this state for a waterproof test of the solar cell wrist watch 101, the moisture channeled into the gap K1 condenses on the back face of the cover glass 5 upon adhering to the cover glass 5. In this way, entry of water into the exterior case 2 can be confirmed.

If the gap K1 is not in communication with the space AR1 through the base openings 14*a* to 14*e*, air movement in the gap K1 and space AR1 is restricted. In other words, for example, the moisture-containing air will not be channeled into the gap K1 even when water enters the space AR1 inside the exterior case 2. Accordingly, condensation does not occur on the cover glass 5 even at elevated temperatures inside the exterior case 2.

Thus, in Second Embodiment, the cut-away portions 41 formed in the flange portion 17 of the glass packing 115 facilitate smooth movement of air between the gap K1 (created between the cover glass 5 and the solar panel 6) and the space AR1 (created between the caseback 19 and the base portion 9). This makes it possible to improve the accuracy of a waterproof test.

Further, because the cut-away portions 41 of the glass packing 115 are formed at positions corresponding to the base openings 14*a* to 14*e* of the base portion 9, the flange portion 17 of the glass packing 115 does not close the base openings 14*a* to 14*e*, and large openings can be provided for the base openings 14*a* to 14*e*. This ensures smooth movement of air between the gap K1 and the space AR1.

Further, because the outer peripheral portion of the cover glass 5 is directly exposed through the base openings 14*a* to 14*e*, the outer peripheral portion of the cover glass can be directly pressed. Thus, the applied pressure efficiently transmits to the cover glass 5, making it possible to remove the cover glass 5 more easily.

Second Embodiment has been described through the case where the flange portion 17 of the glass packing 115 has the cut-away portions 41 formed by cutting the flange portion 17 in position corresponding to the base openings 14*a* to 14*e* formed in the base portion 9. However, the layout is not limited to this, and the cut-away portions 41 may be formed in the flange portion 17 at positions avoiding the base openings 14*a* to 14*e*, provided that the base openings 14*a* to 14*e* are sized not to be completely closed by the flange portion 17 of the glass packing 115.

Third Embodiment

Third Embodiment of the invention is described below with reference to FIG. 9.

Figure 9:
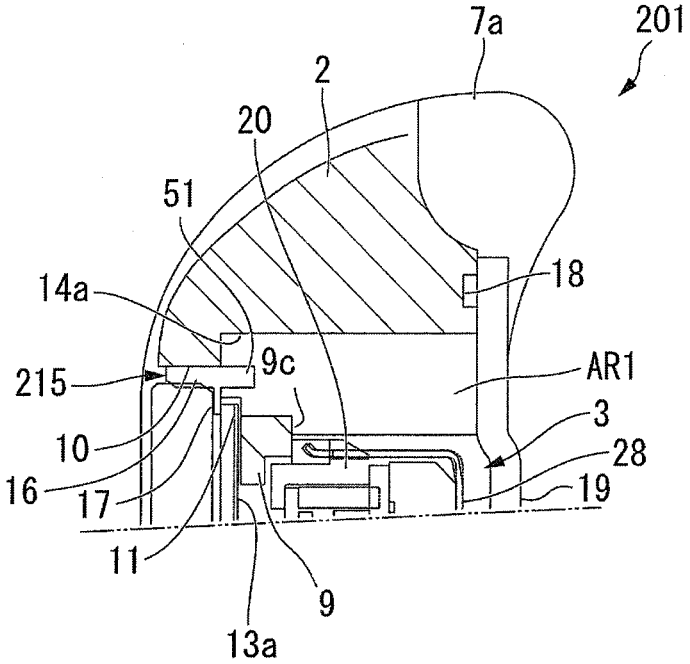
FIG. 9 is a partial longitudinal sectional view of a solar cell wrist watch of Third Embodiment of the invention.

FIG. 9 is a partial longitudinal sectional view of a solar cell wrist watch 201, corresponding in part to FIG. 3.

Third Embodiment differs from First Embodiment in that a glass packing 215 of Third Embodiment has a different shape from that of the glass packing 15 of First Embodiment.

Specifically, as illustrated in FIG. 9, the glass packing 215 does not differ from the glass packing 15 of First Embodiment in that the glass packing 215 is configured from the packing main body 16 disposed along the inner peripheral surface of the case opening 4 of the exterior case 2, and from the flange portion 17 that bends and extends inwardly along the radial direction from an end on the back side of the packing main body 16. However, the glass packing 215 differs from the glass packing 15 in raised portions 51 formed at positions corresponding to the base openings 14*a* to 14*e* of the flange portion 17 so as to face the base openings 14*a* to 14*e*.

In this configuration, the raised portions 51 facing the base openings 14*a* to 14*e* are pressed with a jig or the like (not illustrated) to remove the cover glass 5 from the exterior case 2. In this way, the cover glass 5 can be pushed outward and removed.

Thus, in Third Embodiment, the glass packing 215 has the raised portions 51 respectively facing the base openings 14*a* to 14*e*, and thus a load can be more easily applied to the glass packing 215 pressed through the base openings 14*a* to 14*e*. In other words, the applied pressure can transmit more easily to the cover glass 5 via the glass packing 215. Thus, the removal of the cover glass 5 can be performed more easily than when the raised portions 51 are not formed.

It should be noted that the invention is not limited to the foregoing embodiments, and may be varied in many ways from the foregoing embodiments within the gist of the invention.

For example, the foregoing embodiments describing the solar cell wrist watches 1, 101, and 201 as embodiments of the solar cell electronic device of the invention are not limited thereto, and the invention is also applicable to various solar cell electronic devices configured to include a solar panel disposed on the back face of the cover glass, and in which the opening of the exterior case is closed by the cover glass.

Further, the foregoing embodiments described the base portion 9 of the exterior case 2 as having a total of five base openings 14*a* to 14*e* formed on the 12 o'clock, 3 o'clock, 5 o'clock, 7 o'clock, and 9 o'clock side, respectively. However, the invention is not limited to this, and the base openings may be disposed apart from one another with respect to the center in the central portion of the case opening 4, specifically with respect to the center in the planar central portion of the cover glass 5. In other words, for example, the base openings 14*a* to 14*e* may be disposed in such a manner that the planar central portion of the cover glass 5 is confined within the region surrounded by lines connecting the base openings 14*a* to 14*e*.

Further, it is not necessarily required to form five base openings 14*a* to 14*e*, and at least one base opening, preferably 2 or more base openings may be formed.

When two or more base openings are formed, the base openings may be disposed apart from each other with respect to the center in the planar central portion of the cover glass 5. Specifically, for example, when providing two base openings, the two base openings maybe disposed on the opposite sides of the planar central portion of the cover glass 5.

When three or more base openings are provided, the base openings may be disposed in such a manner that the planar central portion of the cover glass 5 is confined within the region surrounded by lines connecting the base openings.

What is claimed is:

1. A solar cell electronic device, comprising:

an exterior case having a case opening;

a packing attached to the case opening;

a cover glass mounted on the exterior case so as to be fitted into the case opening via the packing, and to close the case opening; and a solar panel disposed on a back face of the cover glass over a large area in a planar central portion of the cover glass with a predetermined distance from the cover glass, the case opening having a base portion formed on the inner periphery thereof for mounting an outer peripheral portion of the cover glass, and for positioning the solar panel in a plane direction, the packing including:

a main body portion interposed between the case opening and the cover glass; and a flange portion that extends from an end on the base portion side of the main body portion, and that is interposed between the cover glass and the base portion, the base portion having a base opening through which at least a part of the flange portion of the packing is exposed.

2. The solar cell electronic device according to claim 1, wherein the packing has a cut-away portion formed in a part of the packing by cutting the flange portion.

3. The solar cell electronic device according to claim 2, wherein the base opening is formed at a position corresponding to the cut-away portion.

4. The solar cell electronic device according to claim 1, wherein a raised portion is formed at a position corresponding to the base opening of the packing so as to face the base opening.

5. The solar cell electronic device according to claim 2, wherein a raised portion is formed at a position corresponding to the base opening of the packing so as to face the base opening.

6. The solar cell electronic device according to claim 3, wherein a raised portion is formed at a position corresponding to the base opening of the packing so as to face the base opening.

7. The solar cell electronic device according to claim 1, wherein the base opening is disposed in at least two locations apart from each other with respect to the center in a planar central portion of the cover glass.

8. The solar cell electronic device according to claim 2, wherein the base opening is disposed in at least two locations apart from each other with respect to the center in a planar central portion of the cover glass.

9. The solar cell electronic device according to claim 3, wherein the base opening is disposed in at least two locations apart from each other with respect to the center in a planar central portion of the cover glass.

10. The solar cell electronic device according to claim 4, wherein the base opening is disposed in at least two locations apart from each other with respect to the center in a planar central portion of the cover glass.

11. The solar cell electronic device according to claim 5, wherein the base opening is disposed in at least two locations apart from each other with respect to the center in a planar central portion of the cover glass.

12. The solar cell electronic device according to claim 6, wherein the base opening is disposed in at least two locations apart from each other with respect to the center in a planar central portion of the cover glass.

* * * * *